US006158877A

United States Patent [19]

Zadro

[11] Patent Number: 6,158,877

[45] **Date of Patent: *Dec. 12, 2000**

[54] MAGNIFYING MIRROR HAVING FOCUSED ANNULAR ILLUMINATOR

[76] Inventor: Zlatko Zadro, 16742 Wanderer, Huntington Beach, Calif. 92649

[ * ] Notice: This patent issued on a continued prosecution application filed under 37 CFR 1.53(d), and is subject to the twenty year patent term provisions of 35 U.S.C. 154(a)(2).

[21] Appl. No.: 09/055,114

[22] Filed: Apr. 3, 1998

[51] Int. Cl.[7] ..... F21V 33/00

[52] U.S. Cl. ..... 362/216; 362/311; 362/135

[58] Field of Search ..... 362/135, 138, 362/216, 551, 311, 410, 414; 359/839

[56] References Cited

U.S. PATENT DOCUMENTS

| | | | |
|---|---|---|---|
| 1,774,331 | 8/1930 | Koller | 362/135 |
| 1,786,420 | 12/1930 | Braly | 362/135 |
| 3,266,016 | 8/1966 | Maryama et al. | 362/135 |
| 5,442,488 | 8/1995 | Pastorino | 362/135 |

FOREIGN PATENT DOCUMENTS

| | | | |
|---|---|---|---|
| 392284 | 5/1933 | United Kingdom | 362/135 |

*Primary Examiner*—Thomas M. Sember
*Attorney, Agent, or Firm*—William L. Chapin

[57] ABSTRACT

A mirror device includes a frame comprising a circular ring-shaped light transmissive body which supports a concave magnifying mirror plate. The body has a front beveled annular light exit surface which angles inwardly and rearwardly from the outer side wall of the body to the inner side wall of the body, which has an annular shoulder flange which supports the peripheral edge of the mirror plate. The outer and inner side walls of the body curve longitudinally rearwardly and inwardly, terminating in an annular-shaped rear leg portion located behind the mirror plate. The rear leg portion has an inner, longitudinally disposed, cylindrical light entrance surface within which is located a ring-shaped lamp. Light rays entering the cylindrical light entrance surface are piped forward by total internal reflection within the support body to exit from the beveled front annular light exit surface, which is beveled at an angle which causes an annular cone of light to be focused near the focal point of the mirror plate, thereby effectively illuminating a face or other object placed close to the mirror.

20 Claims, 10 Drawing Sheets

MAGNIFYING MIRROR HAVING FOCUSED ANNULAR ILLUMINATOR

BACKGROUND OF THE INVENTION

A. Field of the Invention

The present invention relates to mirrors of the type generally used by people to assist in shaving, applying facial cosmetics and performing other personal hygiene tasks,. More particularly, the invention relates to a magnifying mirror having an integral annular-shaped illuminator which effectively illuminates a face or other object positioned close to the surface of the mirror.

B. Description of Background Art

Mirrors used by individuals to view the face while applying cosmetics, shaving, or performing other tasks related to an individual's appearance or personal hygiene are of two main types. The first type includes the relatively large, typically rectangular mirrors which are mounted at eye level on a wall or bathroom wall cabinet. The other type of mirror includes relatively smaller oval or circular mirrors having a diameter of about 8 inches, and which may be mounted in a handle, on a support stand attachable to a wall or other structure, or on a free-standing support stand which may be placed on the horizontal upper surface of a dresser, vanity cabinet or the like. Mirrors of the second category may be flat, providing a unity magnification. However, for certain applications, such mirrors may have a concave, usually spherical reflecting surface, thus producing a magnified image of an object such as the face, when it is placed between the reflective surface of the mirror and its focal point, which is located at the center of curvature of the mirror.

Thus, for example, when a person who may be somewhat nearsighted wishes to install or remove their contact lenses, flat mirrors having a one-to-one, or unity, magnification factor may be inadequate for the task. In such cases, it would be desirable to use a concave, magnifying mirror, typically having a magnification factor in the approximate range of about three times to several times (3 X to 7 X). Magnifying mirrors are also used routinely to assist in performing with greater ease and/or more precision such tasks as applying cosmetics, shaving and performing other activities related to personal appearance or hygiene.

Although the uses of magnifying mirrors may be desirable or even necessary for performing certain of the tasks referred to above, the use of existing magnifying mirrors can be problematic, for the following reason. Since the face of a person using a magnifying mirror must be located quite close to the concave reflecting surface of the mirror, ambient illumination of the face is substantially blocked, both by the mirror and the person's head. Thus, although features of the face which one wishes to view are magnified, they may be so deeply shaded as to be difficult to view.

In apparent recognition of the problem of adequately illuminating the face of a person positioned close to the surface of a magnifying mirror, a variety of solutions have been proposed. One such solution utilizes one or more light sources positioned around the periphery of a magnifying mirror. A second solution to the problem of illuminating the face of a person placed close to the surface of a magnifying mirror utilizes a light source positioned within the periphery of the mirror, the source penetrating the mirror and directing rays of light forward to at least a portion of a person's face close to the light source. A third approach to illuminating a face positioned near the surface of a magnifying mirror utilizes an annular light diffuser ring or "halo" which encircles a circular magnifying mirror. The diffuser ring is typically illuminated by an incandescent lamp located behind the mirror.

Each of the aforementioned existing approaches to illuminating an object such as a face positioned sufficiently close to the surface of a concave mirror to afford a clear magnified image of the object possesses certain inherent disadvantages. For example, the first method requires a plurality of illumination sources, and does not provide circumferentially uniform illumination of the face. The second method provides even less uniform illumination of the face, since the light rays from the single source are directed only to a portion of the face, while the rest of the face is not illuminated at all by the light source. The third method inefficiently directs the light over a large solid angle from an annular diffuser, thereby requiring an excessively bright, high powered light source to achieve the desired levels of illumination of the face. As a general rule, existing mirrors use light sources which produce diverging beams of light which are inherently ineffective in illuminating an object located close to the surface of the mirror. External light sources used with prior art mirrors also tend to be bulky and can produce undesirable heat and glare, especially when a person's face is positioned close to the mirror. The present invention was conceived of to provide a magnifying mirror having an integral light source which efficiently illuminates a person's face located close to the surface of the mirror.

OBJECTS OF THE INVENTION

An object of the invention is to provide a magnifying mirror having an integral annular illuminator which may be used to effectively and efficiently illuminate the surface of a person's face placed near to the surface of the mirror.

Another object of the invention is to provide a concave magnifying mirror having an integral illuminator which encircles the mirror, and which directs a converging, conically tapered annular ring of light forward towards the face.

Another object of the invention is to provide a magnifying mirror device which includes a circular concave mirror plate, a ring-shaped light pipe having an annular front light beam exit surface which encircles the mirror, and a light source which illuminates a cylindrical light beam entrance surface located on a rear portion of the light pipe.

Another object of the invention is to provide a magnifying mirror device which includes a circular concave mirror, an annular ring-shaped light pipe having a front annular light beam exit surface which encircles the mirror and a rearwardly and inwardly curved portion which is illuminated by a toroidal-shaped light source.

Another object of the invention is to provide a magnifying mirror device which includes an annular ring-shaped light pipe, the light pipe having a front portion which encircles the periphery of the mirror and front beveled light beam exit surface angled inwards and rearwards from the periphery of the front portion of the light pipe towards the periphery of the mirror.

Another object of the invention is to provide a magnifying mirror device provided with an integral illumination source located substantially behind the mirror, thereby resulting in a compact device.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends a mirror device including a concave magnifying mirror and an integral annular illuminator which encircles the mirror and provides a relatively uniform pattern of illumination on the face of a person positioned close to the surface of the mirror. The mirror device according to the present invention includes a frame consisting of a shallow, circular ring-shaped support body which supports the outer peripheral edge of a concave mirror plate within a recessed shoulder flange in the front inner side wall of the body. The ring-shaped support body includes a front portion which has a convex, arcuately curved, generally longitudinally and rearwardly disposed outer side wall. The support body also has a ring-shaped rear leg portion which curves radially inwards towards the center of the ring, the rear leg portion terminating in a longitudinally disposed inner cylindrical wall surface of smaller diameter than the mirror plate. Within the rear ring-shaped leg portion of the support body, which is located behind the mirror plate, is located a ring-shaped lamp, the outer toroidal surface of which is adjacent to the inner cylindrical wall surface of the rear leg portion. The support body is made of a light transmitting material, such as a clear acrylic plastic. Accordingly, light rays, emanating from the surface of the lamp adjacent the cylindrical inner wall surface of the support ring leg enter into the interior of the ring-shaped support body.

The inner and outer walls of the support body are curved so that a substantial portion of the light rays which enter the support ring leg impinge the inner wall surfaces of the support body at an angle greater than the critical angle of the body material, which angle is about 42 degrees for acrylic plastic. Light rays impinging inner wall surfaces at incident angles of greater than 42 degrees are trapped within the support body by the phenomenon known as total internal reflection, and are thus conducted radially outwards and longitudinally forwards towards the front of the support body.

The front portion of the support body has a beveled annular surface which courses radially inwards and rearwards from the outer circumferential surface of the body, to the shoulder flange which supports the mirror plate. Since the beveled surface is disposed substantially transversely to the longitudinal axis of the support body, light rays piped forward through the support body impinge the beveled surface at incident angles less than the critical angle, and are therefore transmitted out through the beveled surface towards a location in front of the mirror plate. Light rays emanating from the beveled illuminator exit surface lie in an annular region which converges to a conical area in front of the mirror plate, thus effectively illuminating objects such as a person's face located close to the mirror plate.

BRIEF DESCRIPTION OF THE DRAWINGS

FIG. 1 is a front elevation view of a magnifying mirror device housing a focused annular illuminator according to the present invention in which

FIG. 7 is a partly diagrammatic view of the device of FIG. 5, showing the path of light rays through the light-piping support body in which

DESCRIPTION OF THE PREFERRED EMBODIMENTS

FIGS. 1–13 illustrate various aspects of a magnifying mirror device having a focused annular illuminator according to the present invention.

Figure 1A:
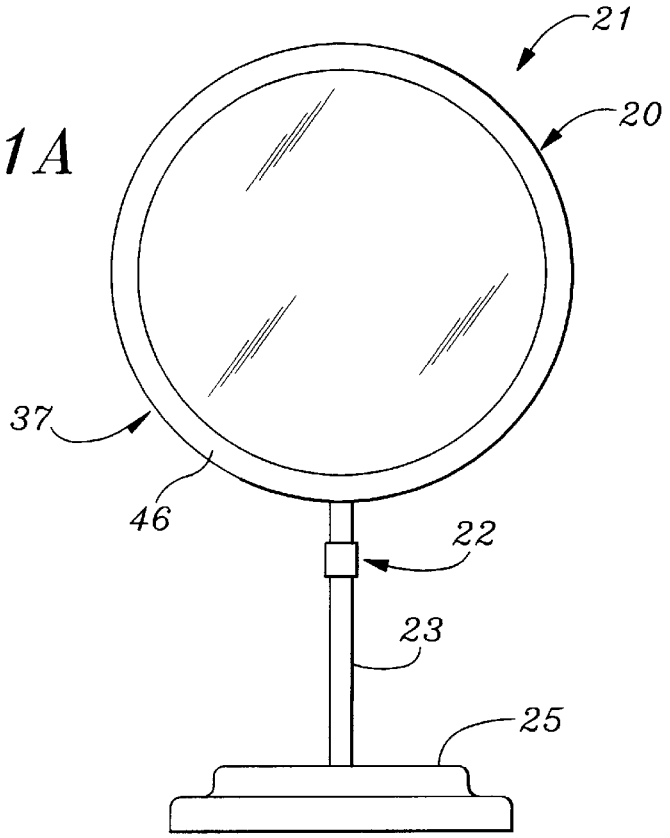
FIG. 1A shows a pedestal mount embodiment and FIG. 1B shows a wall mount embodiment invention.

FIG. 1A illustrates a basic embodiment 21 of the present invention in which a magnifying mirror device 20 according to the present invention, in which the mirror device is mounted on a stand 22 which includes a pedestal 23 which protrudes upwards from a base 25, which is adapted to support the mirror in a free standing configuration on a vanity or dresser.

Figure 1B:
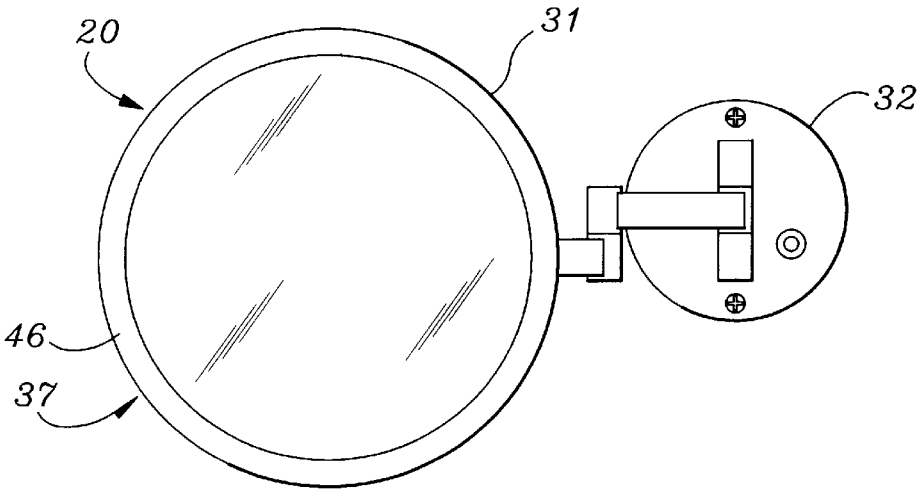

FIG. 1B illustrates another embodiment of the present invention in which a magnifying mirror device 20 according to the present invention is mounted at one end of an articulating arm 26, the other end of the arm being attached to a circular bracket plate 32 adapted to be fastened to a wall.

Figure 1C:
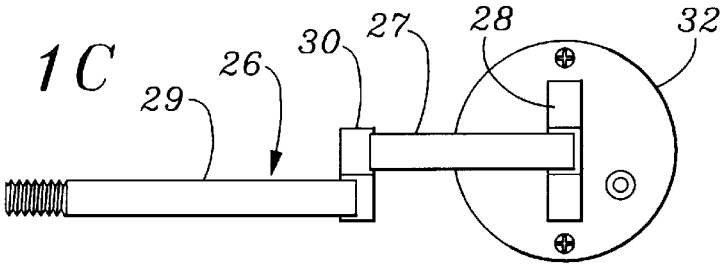
FIG. 1C is a rear elevation view of the wall mount embodiment of FIG. 1.

As shown in FIG. 1C, articulating arm 26 includes an upper arm portion 27 which is fastened to circular bracket plate 32, and a forearm portion 28 pivotably fastened to the upper arm portion by a first pivotable, elbow joint 29. Forearm portion 28 terminates at the front end thereof in a second pivotable, wrist joint 30, which is attached to the rear support plate 31 of mirror device 20.

Figure 5:
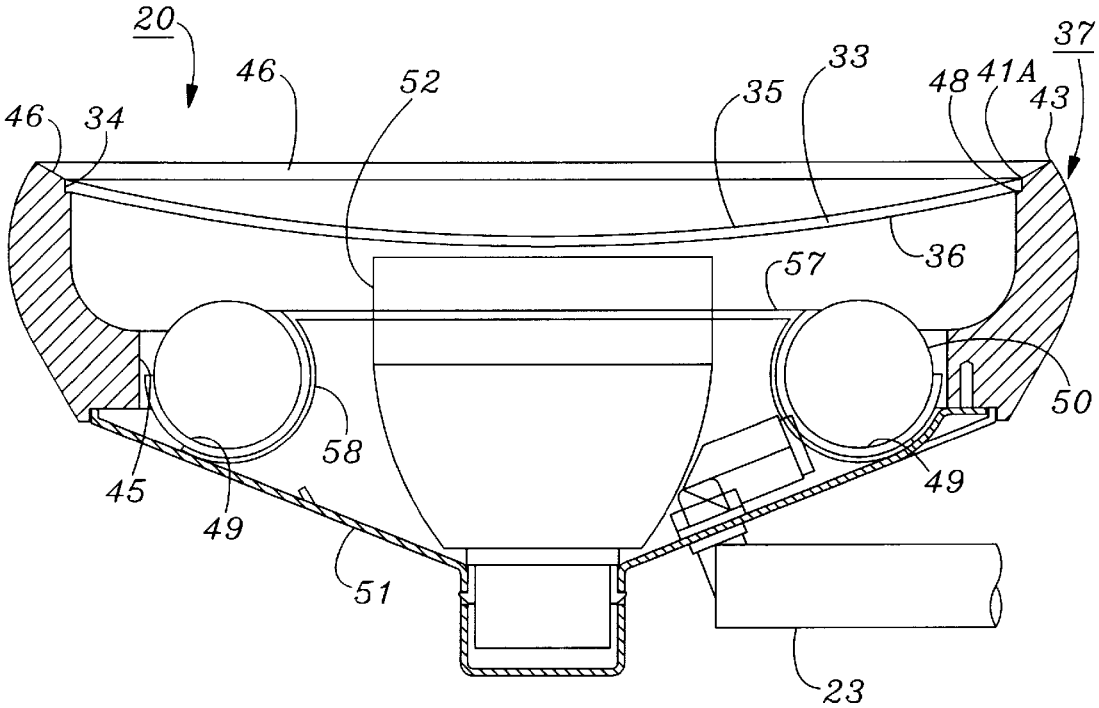
FIG. 5 is a first longitudinal sectional view of the device of FIG. 2A, taken along line 5—5.

Referring now to FIG. 5 in addition to FIG. 1, it may be seen that magnifying mirror device 20 includes a mirror plate 33 having a convex arcuately curved and preferably circular perimeter edge 34. As may be seen best in FIG. 5, mirror plate 33 has a concavely curved front surface 35.

Preferably, curved front surface 35 of mirror plate is a spherical section. Mirror plate 33 has a highly reflective coating on either front surface 35 or rear surface 36 thereof. Preferably, mirror plate 33 is fabricated as a thin plate of glass, clear acrylic or polycarbonate plastic in which the rear surface 36 thereof is aluminized.

Figure 4:
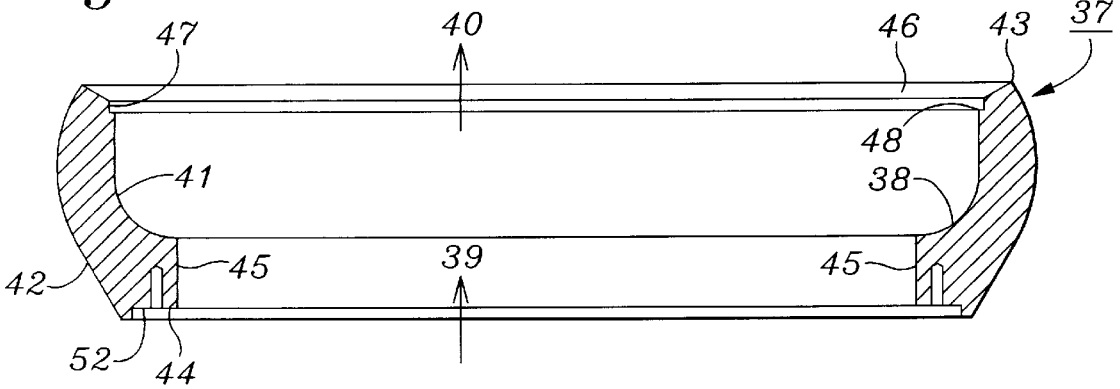
FIG. 4 is a longitudinal sectional view of the body of FIG. 3, taken along line 3—3.

Referring still to FIG. 5, it may be seen that mirror plate 33 is supported at peripheral edge 34 of the mirror plate within a circular ring-shaped frame or support body 37. As shown in FIGS. 4 and 5, support body 37 has a shape approximating that of a large diameter, shallow pan having most of its base 38 cut away by a lower central coaxial bore 39. Thus, as shown in FIG. 4, support body 37 has the appearance of an annular ring having an upper or outer cylindrical bore 40, and inner and outer side walls 41 and 42 which protrude longitudinally inwardly from the outer front circumferential edge 43 of the ring. As may be seen best by referring to FIG. 4, body 37 has at the lower or longitudinally inward end thereof of a radially inwardly protruding, ring-shaped leg section 44. The latter has a longitudinally disposed inner cylindrically-shaped wall surface 45 which circumscribes central coaxial bore 39 through base 38 of frame 37.

Referring still to FIGS. 4 and 5, it may be seen that ring-shaped support body 37 has a beveled front annular wall surface 46 which courses radially and longitudinally inwards from outer circumferential edge 43 of outer side wall 42 to inner side wall 41 of the body. At the intersecting corner edge 41A of beveled front annular surface 46 and inner side wall 41 of body 37, an annular recess 47 having a rectangular cross section is formed. Recess 47 forms in inner side wall 41 an annular shoulder or ledge 48 on which is seated peripheral edge 34 of mirror plate 33. Peripheral edge 34 of mirror plate 33 is held in place within recess 47 by a contact adhesive or similar fastening means.

As will be explained in detail below, ring-shaped mirror support body 37 is used to conduct light rays from an illumination source to front annular wall surface 46 of the body. Accordingly, mirror support body 37 is made from a light transmissive, preferably transparent material such as clear acrylic plastic.

Figure 2A:
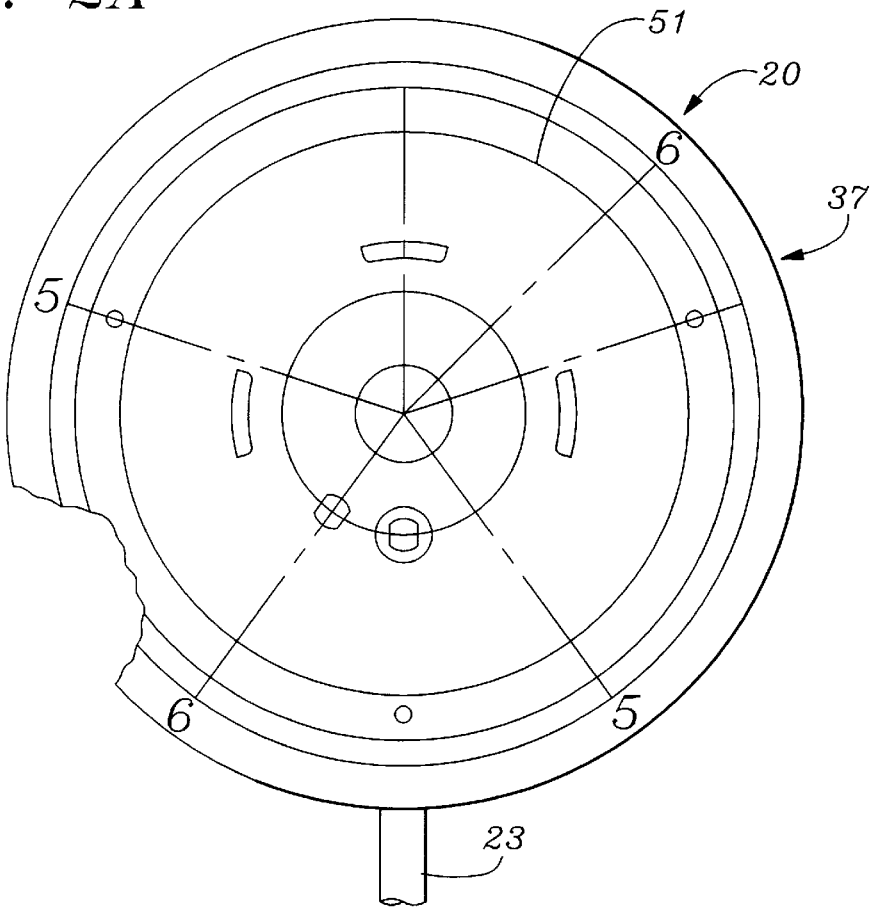
FIG. 2A is a fragmentary front elevation view of the mirror device of FIG. 1, showing the mirror plate thereof removed.
Figure 2B:
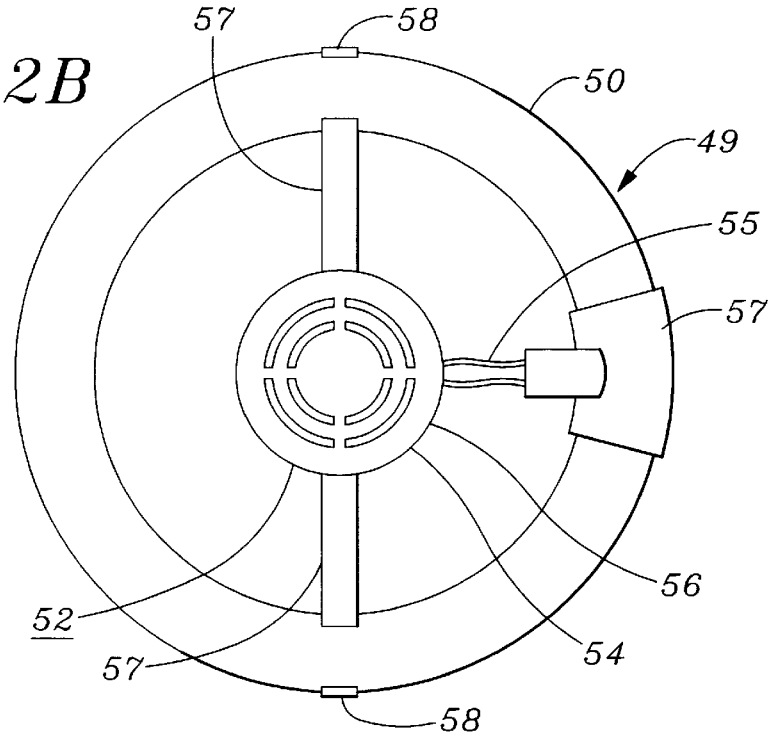
FIG. 2B elevation view of a lamp and ballast comprising part of the device of FIG. 1.
Figure 3:
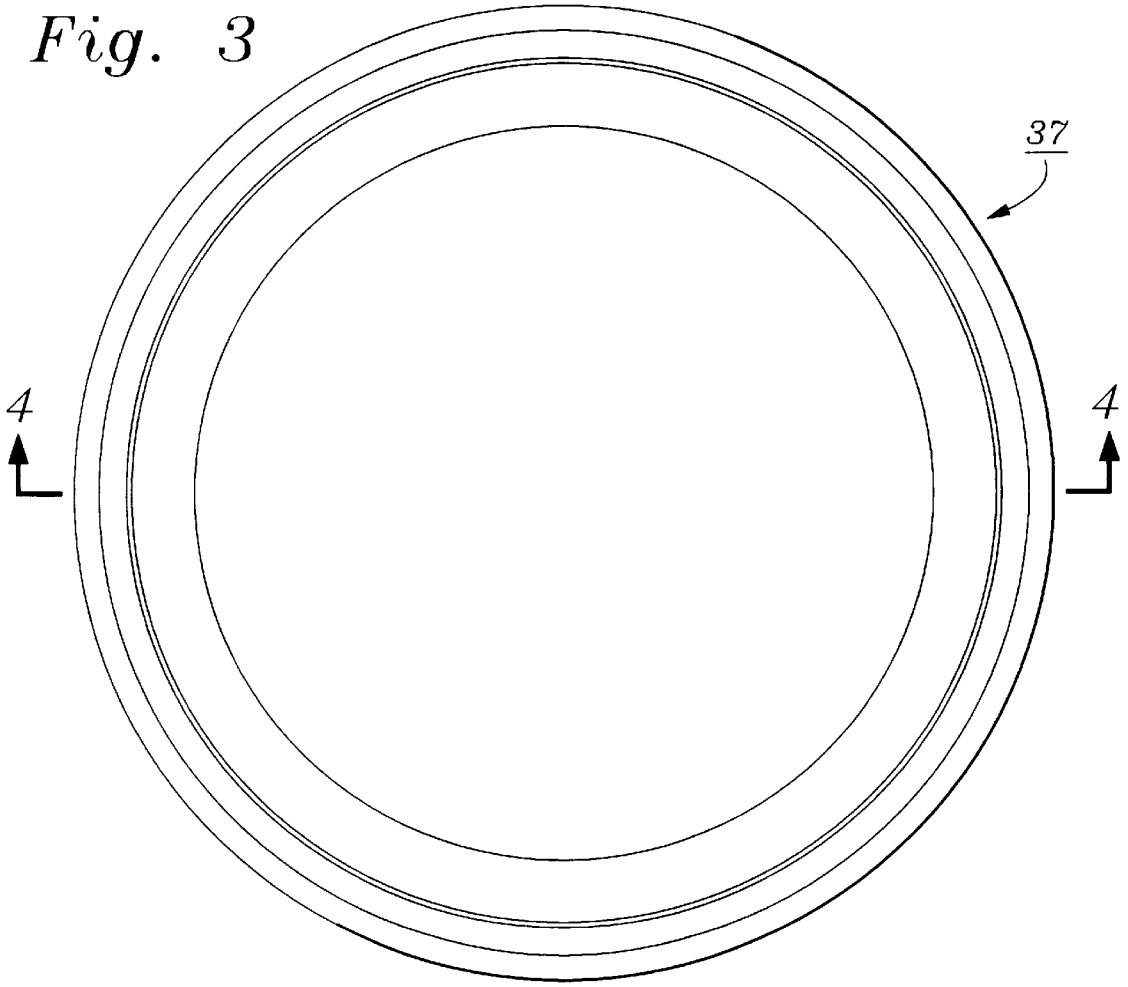
FIG. 3 is a front elevation view of a light-piping support body comprising part of the mirror device of FIG. 2A.

Referring now to FIGS. 2, 4 and 5, it may be seen that magnifying mirror device 20 includes a ring-shaped or toroidal illumination source located within lower central coaxial bore 39 through base 38 of support body 37. Thus, as shown in FIGS. 2, 4 and 5, magnifying mirror device 20 includes a fluorescent ring lamp 49 longitudinally and coaxially centered within bore 39 through base 38 of mirror support body 37. Lamp 49 has an outer diameter slightly smaller than the inner diameter of bore 39 through leg section 44 of support body 37. Thus, the outer toroidal wall surface 50 of lamp 49 is located close to inner cylindrical wall surface 45 of support body leg section 44. With lamp 49 oriented with respect to support body 37 as described above, light rays emitted by the lamp are conducted through the support body and ultimately emitted from beveled front annular surface 46 of the support body, as will now be described.

Figure 7A:
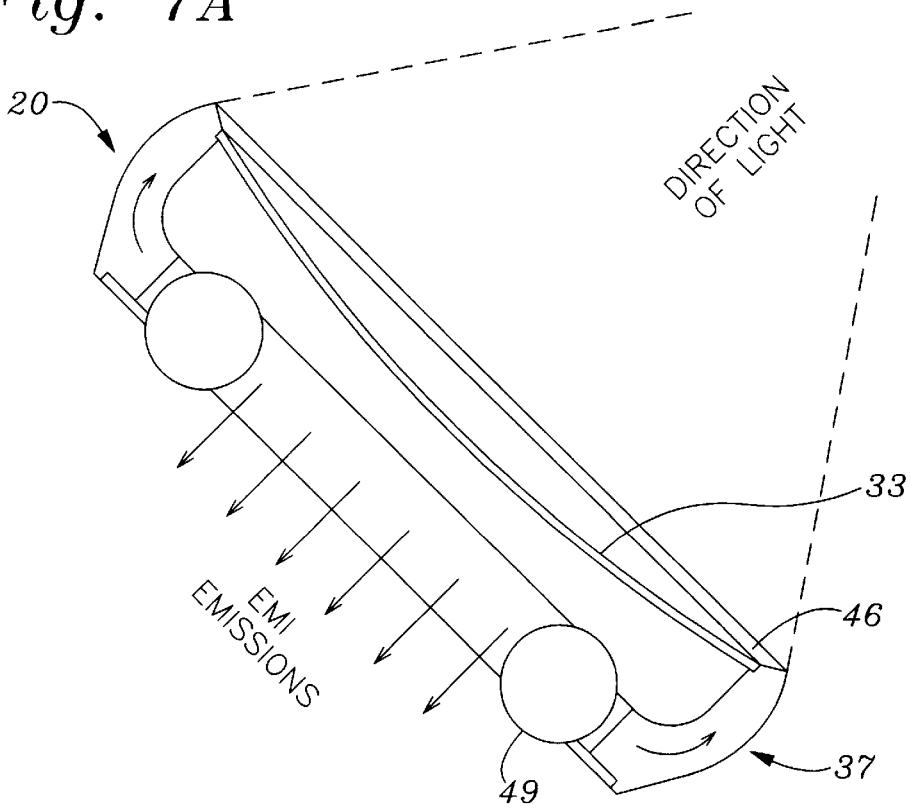
FIG. 7A shows the uniform illumination pattern produced by the rays exterior to the light piping support body.
Figure 7B:
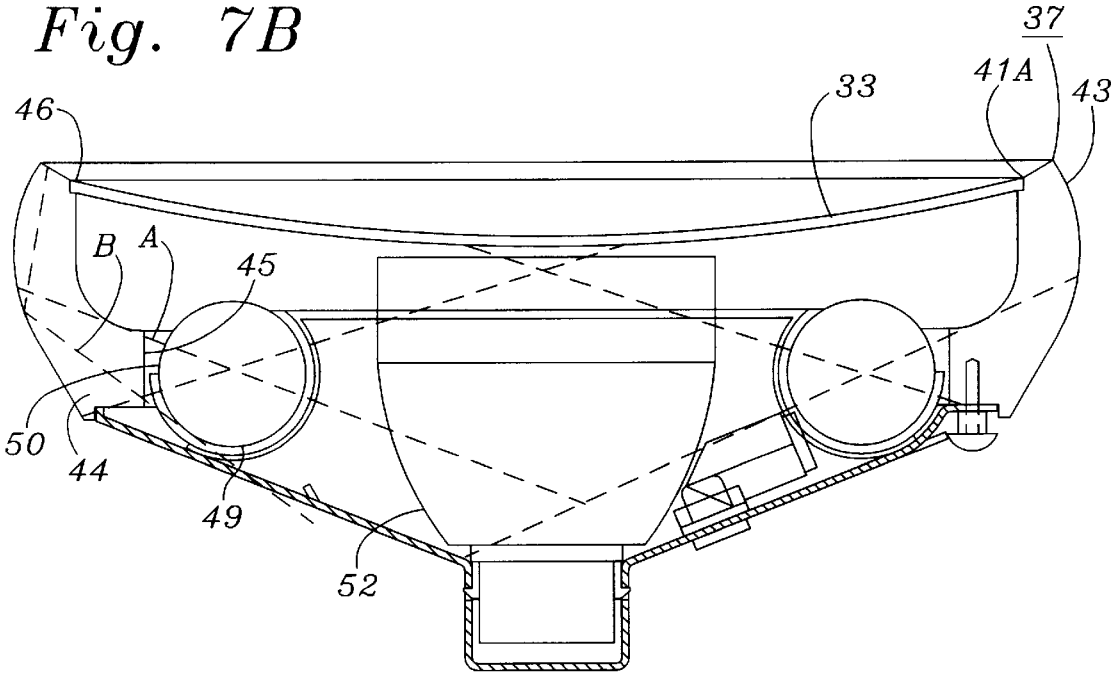
FIG. 7B shows details of light ray paths within the body.
Figure 8A:
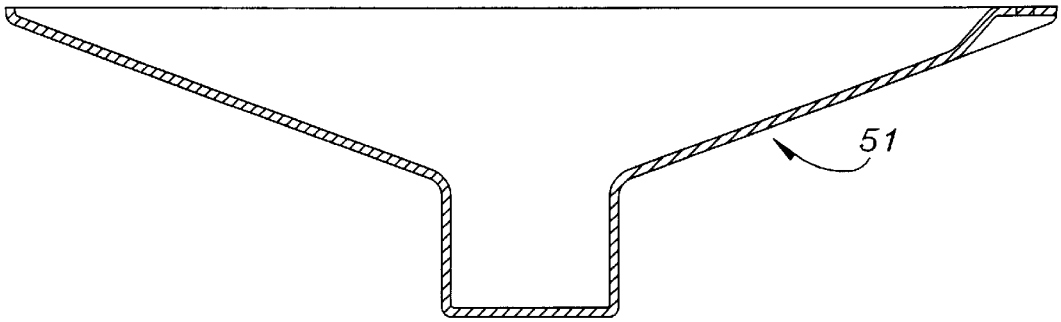
FIG. 8 is a series of views showing a rear cover plate comprising part of the apparatus of FIG. 1.
Figure 8B:
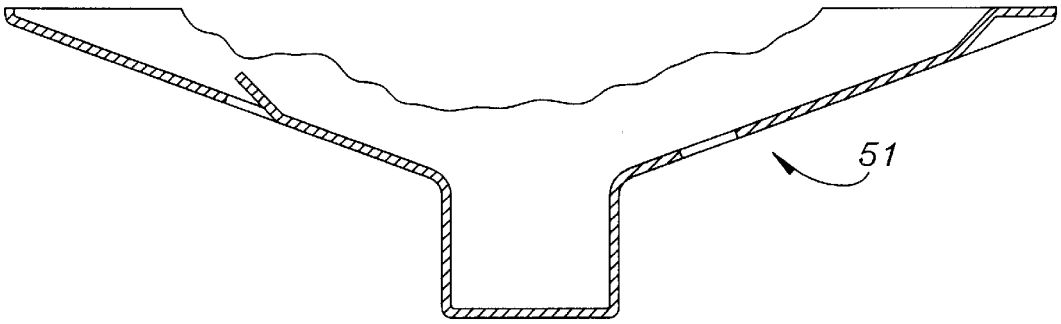
Figure 8C:
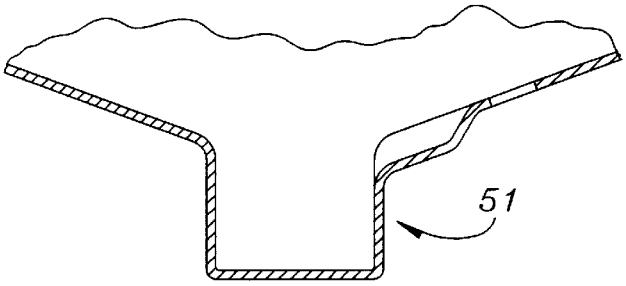
Figure 9:
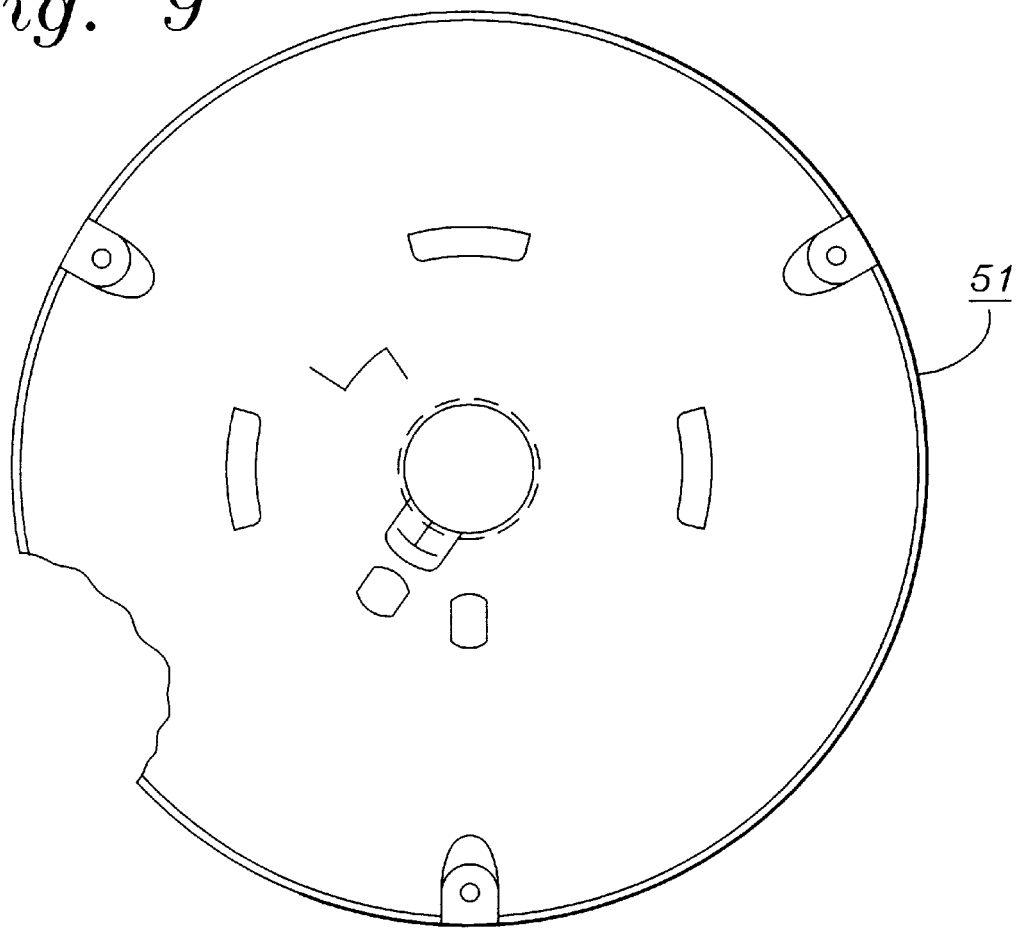
FIG. 9 is a rear elevation view of the cover plate of FIG. 8.

Referring now to FIG. 7, it may be seen that light rays A emanating from the central equatorial region of outer toroidal surface 50 of ring lamp 49 impinge on the inner cylindrical wall surface 45 of rear support ring leg 44 at moderately small incidence angles, and are thus transmitted to the interior of the support ring leg with little reflection. Those rays such as ray B within support ring leg that impinge on a wall surface such as outer side wall surface 42 of support ring 37 at an incident angle greater than the critical angle of the material which the support ring is made of are trapped within the support ring leg by the phenomenon known as total internal reflection, and are thus conducted longitudinally forwards towards beveled front annular wall surface 46 of the body. The critical angle for a transparent material is given the relationship $I_c$=arc sin (1/N). For acrylic plastic having an index of refraction N of 1.5, the critical angle is 42 degrees. Rays B having incidence angles of greater than 42 degrees on wall surfaces 41 and 42 of support body 37 are conducted forward from cylindrical surface 45 of the body, which thus functions as a light entrance surface, to beveled front annular wall surface 46, which thus functions as a light exit surface.

As shown in FIGS. 5 and 7, beveled front annular wall surface 46 of support body 37 is inclined radially inwards and longitudinally rearwardly from outer front circumferential edge 43 of the support body to the circumferential edge 34 of mirror plate 33. Preferably, beveled front annular wall surface 46 is inclined at that angle to the longitudinal axis of mirror plate 33 which causes outwardly directed normals from the beveled light exit surface to intersect the center of curvature of the mirror plate. Since the focal point of mirror plate 33 is located at its center of curvature, light rays exiting from the beveled front annular wall surface 46, the intensity of which are at a maximum along a central normal to the surface, intersect at the focal point of the mirror plate. Accordingly, an annular cone of light having its vertex located near the focal point of mirror plate 33 is emitted from front annular exit surface 46, thereby providing effective illumination of the face or other object positioned between the focal point and front surface of the mirror plate.

Further details of the construction of a magnifying mirror according to the present invention may be best understood by referring to FIGS. 2, 5, 6, 8 and 9 in conjunction with the following description.

Figure 6:
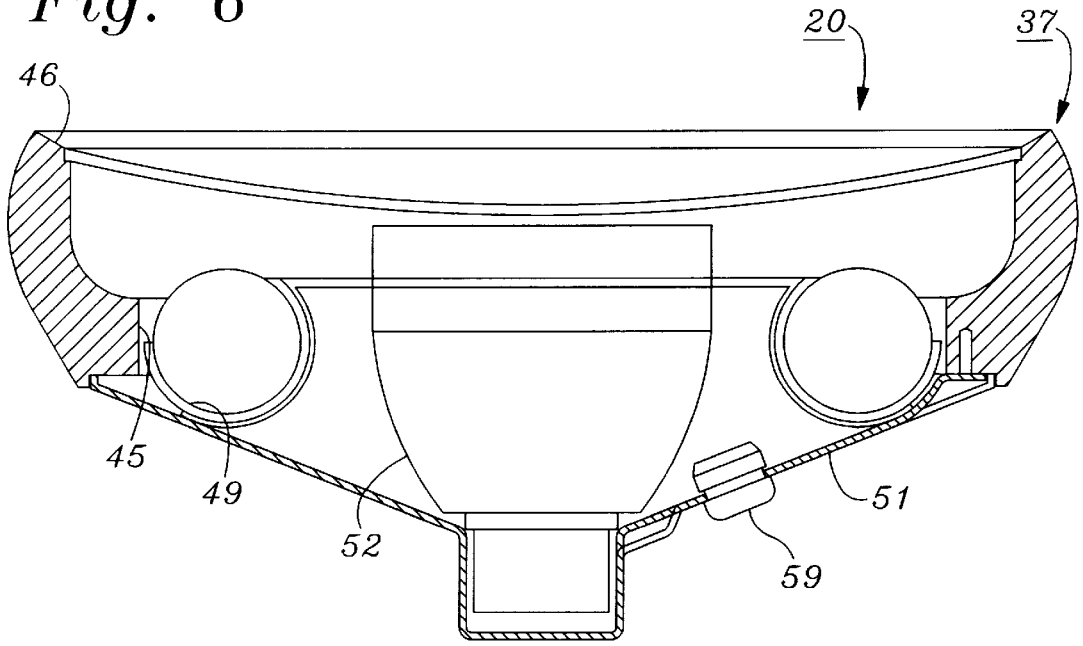
FIG. 6 is a second longitudinal sectional view of the device of FIG. 2A, taken along line 6—6.

Referring now to FIGS. 2, 5, 6, 8 and 9, it may be seen that mirror device 20 preferably includes a dish-shaped backing plate 51 which is attached to the rear annular surface 52 of leg section 44 of support body 37. As shown in FIGS. 2 and 6, mirror device 20 includes a generally frustoconically-shaped ballast 52 which has a flexible electrical line cord 53 which protrudes rearward from the smaller diameter transverse end wall 54 of the ballast. Ballast 52 also has a lamp connection cable 55 which protrudes from longitudinal wall 56 of the ballast and which cable is electrically and mechanically connected to a lamp connector 57 which protrudes radially inward from fluorescent ring lamp 49. Ring lamp 49 and ballast 52 are structurally fastened together by diametrically opposed bracket arms 57 which protrude radially outwards from opposite sides of longitudinal wall 52 of the ballast, each of the arms having at the outer end thereof a U-shaped resilient clamp 58 which engages the tube of ring lamp 49.

Figure 10:
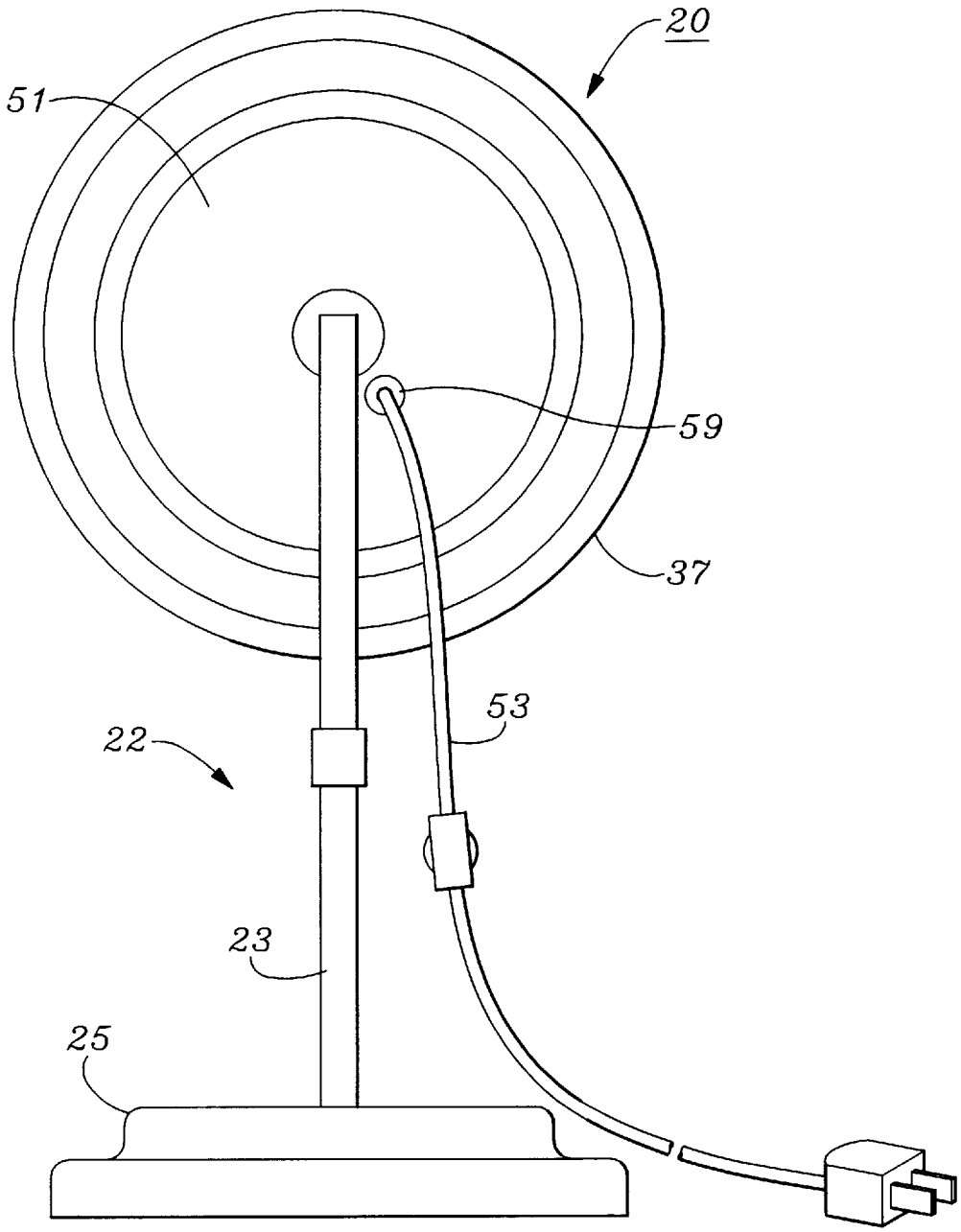
FIG. 10 is a rear elevation view of the mirror device of FIG. 1.
Figure 11:
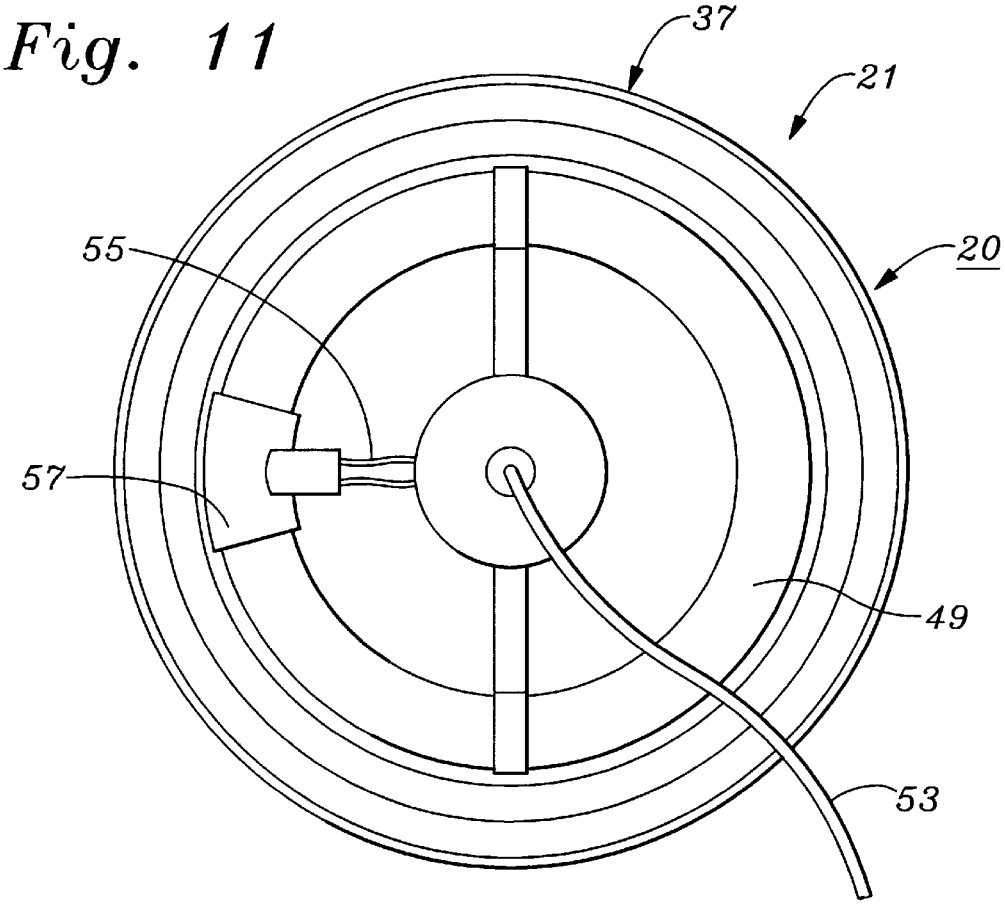
FIG. 11 is a fragmentary rear elevation view of the mirror device of FIG. 1.
Figure 12:
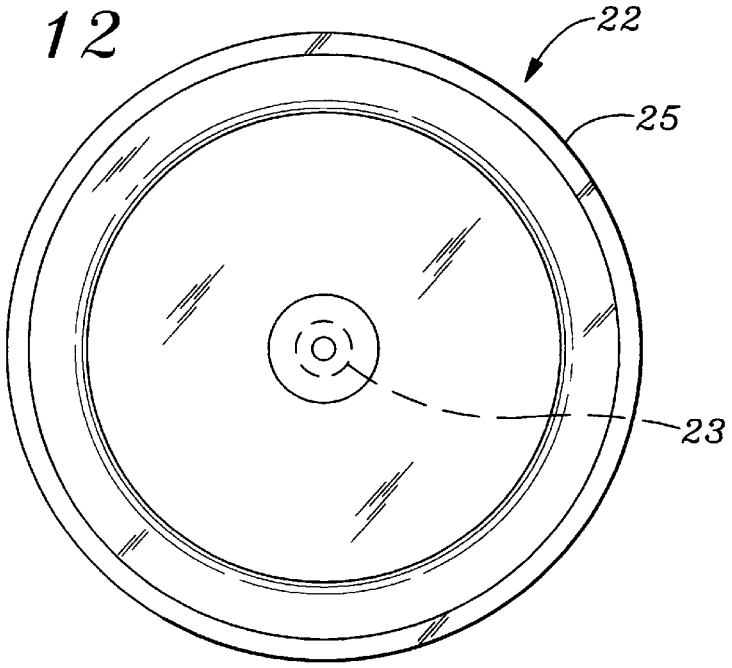
FIG. 12 is a bottom plan view of the mirror device of FIG. 1.

As shown in FIGS. 2, 6 and 10, a grommet 59 is provided through the thickness dimension of backing plate 51, through which passes line cord 53. As may be seen best by referring to FIGS. 2, 5 and 10, mirror device 20 includes a stanchion 60 which is fastened at the upper end thereof to backing plate 51, at the lower end thereof to a support base 61.

Figure 13:
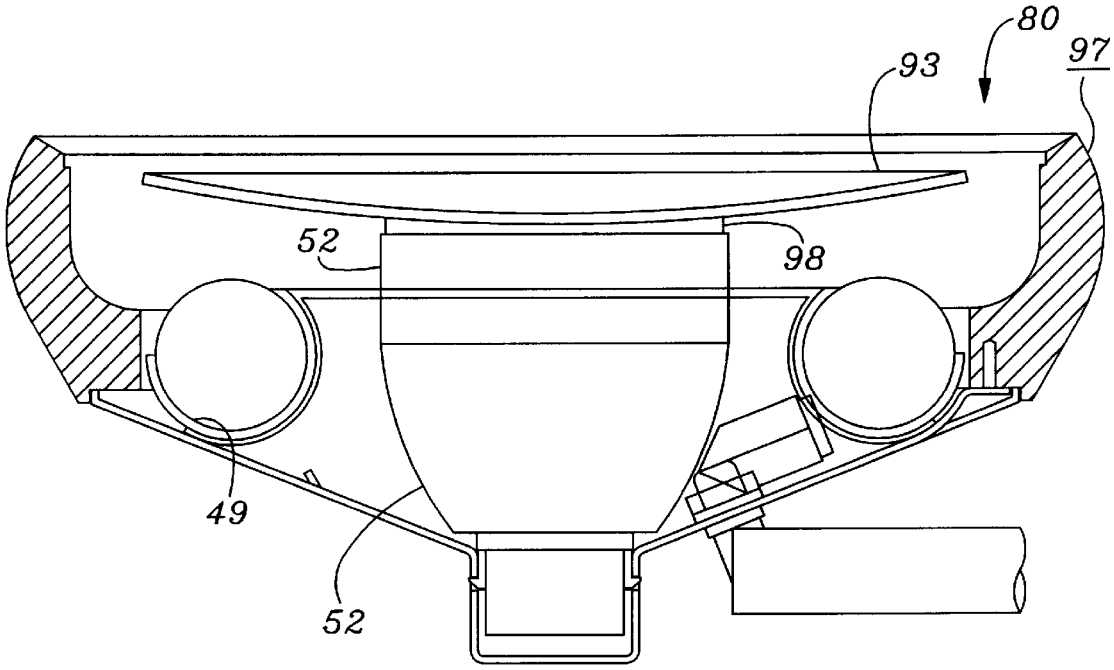
FIG. 13 is a longitudinal sectional view of a modification of the mirror device of FIG. 1.

FIG. 13 illustrates a modification of magnifying mirror device 20 shown in FIGS. 1–6 and described above. Modified mirror device 80, shown in FIG. 13 utilizes a circular mirror plate 93 of smaller diameter than the inner diameter of ring-shaped support body 97. In modified mirror device 80, mirror plate 93 is not fastened directly to the inner side wall of support body 97. Thus, as shown in FIG. 13, mirror plate 93 is secured to mirror device 80 by different means, as for example, by a circular disk of foam tape 98 coated on both sides with a pressure sensitive adhesive.

Each embodiment of a mirror device according to the present invention and described above includes a concave, magnifying mirror plate and a frame comprising an annular body which pipes light forward from a light source behind the mirror into an annular cone that illuminates an object such as the face located in front of and close to the mirror. The novel design and construction of the invention including the light piping frame could also use a flat, non-magnifying mirror plate.

This embodiment of the invention would be useful in applications where it was desired to illuminate objects such as the face positioned close to a flat, non-magnifying mirror, which close placement is often necessary when using a smaller mirror. For mirrors having a smaller magnification, the bevel angle of the front annular light emitting surface could be made less acute, thus increasing the cone angle of the annular illumination pattern and thereby locating the vertex of the cone further from the front surface of the mirror plate.

What is claimed is:

1. A mirror device comprising;

a. a mirror plate having a reflective surface, b. a frame having a front portion which at least partially encircles the periphery of said mirror plate, said frame comprising a ring-shaped body for conducting light from an entrance surface to an exit surface thereof, said body being made of a material which is at least partially light-transmissive, said body having a front ring-shaped light exit surface, a rear light entrance surface, and an intermediate portion disposed between said front and rear surfaces, said intermediate portion having an arcuately curved, convex outer surface which is inclined to light rays entering said rear light entrance surface at an angle greater than the critical angle for total internal reflection of said material, and c. a light source effective in introducing light rays through said rear light entrance surface into said intermediate portion of said body, said rays impinging on said curved outer surface at an angle greater than said critical angle, whereby said rays are conducted from said rear light entrance surface to said front light exit surface by total internal reflection.

2. The mirror device of claim 1 wherein said front ring-shaped light emitting surface is further defined as being inclined radially inwardly and rearwardly from the front outer peripheral edge of said ring-shaped body towards the periphery of said mirror plate whereby a normal to said light emitting surface intersects the longitudinal axis of said mirror plate at a location in front of said mirror plate.

3. The mirror of claim 1 wherein said light is conducted from said rear light entrance surface through said intermediate portion of said body to said front light exit surface at least partially by total internal reflection.

4. The mirror of claim 1 wherein said mirror plate is further defined as having a convex arcuately curved perimeter edge.

5. The mirror of claim 1 wherein said mirror plate is further defined as having a circular outline.

6. The mirror of claim 5 wherein said mirror plate is further defined as having a concavely curved front surface.

7. The mirror of claim 6 wherein said front ring-shaped light exit surface is further defined as being a beveled annular surface which courses radially inwardly and rearwardly from the front outer circumferential edge of said frame body to the peripheral edge of said mirror plate.

8. A mirror device comprising;

a. a mirror plate having a reflective surface and a circular peripheral edge, b. a frame for said mirror plate comprising a ring-shaped support body for conducting light from a light source to an exit surface of said support body, said support body being made of a material which is at least partially light transmissive and which at least partially encircles said peripheral edge of said mirror plate, said support body having a front annular light exit surface which circumscribes said mirror plate, a ring-shaped intermediate longitudinal portion which protrudes rearwardly from said front annular light exit surface, and a rear ring-shaped leg portion, said leg portion having a ring-shaped light entrance surface, said intermediate longitudinal portion having an arcuately curved, convex outer surface which is inclined to light rays entering said ring-shaped light entrance surface of said ring-shaped rear leg portion at an angle greater than critical angle for total internal reflection of said material, and c. a ring-shaped light source adjacent to said light entrance surface, said light source being effective in introducing light rays through said rear light entrance surface into said intermediate portion of said body, said rays impinging on said curved outer surface at an angle greater than said critical angle, whereby said rays are conducted from said rear light entrance surface to said front light exit surface by total internal reflection.

9. The mirror of claim 8 wherein said ring-shaped intermediate longitudinal portion of said support body is further defined as having longitudinally disposed inner and outer side walls adapted to conduct by total internal reflection light rays from said light entrance surface to said front light emitting surface.

10. The mirror of claim 9 wherein said leg portion of said ring-shaped frame body is further defined as curving radially inwards towards the center of said body.

11. The mirror of claim 10 wherein said light entrance surface is further defined as being a longitudinally disposed, inner cylindrical surface of said leg portion of said body.

12. The mirror of claim 8 wherein said front annular light exit surface is further defined as being beveled, said beveled surface being inclined radially inwardly and rearwardly from the front outer circumferential edge of said body to the peripheral edge of said mirror plate.

13. The mirror of claim 12 wherein said mirror plate is further defined as having a concave front surface.

14. The mirror of claim 13 wherein said mirror plate is further defined as having a concave spherical front surface.

15. A magnifying mirror device comprising;

a. a circular reflective mirror plate having a concave front surface, b. a frame for said mirror plate comprising a circular ring-shaped support body for conducting light from a light source into a region in front of said mirror plate, said support body being made of an at least partially light transmissive material and having a shape approximating that of a shallow circular pan with thick, outwardly bowed inner and outer side walls and a large circular, central coaxial portion of the base of the pan cut away to leave a radially inwardly protruding annular ring-shaped leg section having on the inner circumferential edge thereof a longitudinally disposed, cylindrically-shaped light entrance surface, the support body having a front annular light exit surface disposed transversely from the outer longitudinal side wall to the inner longitudinal side wall of said body, said outwardly bowed outer side wall of said support body being inclined to light rays entering said cylindrically-shaped light entrance surface at an angle greater than the critical angle for total internal reflection of light rays in said material, and c. a ring-shaped lamp having a smaller outer diameter than the inner diameter of said cylindrically-shaped light entrance surface, said lamp being located coaxially and at least partially longitudinally within said cylindrically-shaped light entrance surface said rays impinging on said outwardly bowed outer side wall of said support body at an angle greater than said critical angle, whereby said rays are conducted through said support body from said entrance surface to said exit surface thereof by total internal reflections.

16. The mirror device of claim 15 wherein said front annular light exit surface is further defined as being a beveled surface which is inclined radially inwardly and rearwardly from the front corner edge of the outer side wall of said body to the front inner corner of the inner side wall of said body.

17. The mirror device of claim 16 wherein the annular intersection between said beveled annular light exit surface and said inner side wall of said body has formed therein a recess having a transversely disposed wall comprising an annular shoulder flange on which is seated the peripheral edge of said mirror plate.

18. The mirror device of claim 15 wherein said cylindrical light entrance surface, said inner and said outer side walls of said body are shaped and arranged relative to one another so that a substantial portion of light rays which enter said body through said light entrance surface impinge internally on said inner and outer wall surfaces at incident angles greater than the critical angle of said light transmissive material from which said body is made.

19. The mirror device of claim 18 wherein said beveled light exit surface is further defined as being inclined at that angle to the longitudinal axis of said mirror plate that causes central normal rays emitted from said light exit surface to intersect said longitudinal mirror axis at an intersection region proximate the focal point of said mirror.

20. The mirror device of claim 19 wherein said intersection region is further defined as being between said mirror plate and its focal point.

* * * * *